United States Patent [19]

Rachman

[11] Patent Number: 4,830,567

[45] Date of Patent: May 16, 1989

[54] PORTABLE WHEELCHAIR LIFT

[76] Inventor: Isadore B. Rachman, (A-202) Linden Ct., Philadelphia, Pa. 19114

[21] Appl. No.: 110,309

[22] Filed: Oct. 20, 1987

[51] Int. Cl.[4] ..... A61G 5/00

[52] U.S. Cl. ..... 414/678; 280/304.1; 297/272; 297/310; 297/DIG. 4; 414/921

[58] Field of Search ..... 414/678, 921; 280/289 WC; 297/272, 310, DIG. 4

[56] References Cited

U.S. PATENT DOCUMENTS

| | | | |
|---|---|---|---|
| 1,591,529 | 6/1926 | Guerber . | |
| 1,697,364 | 1/1929 | McCollum et al. . | |
| 2,295,006 | 8/1942 | Philips | 5/82 |
| 2,300,165 | 10/1942 | Mustafa . | |
| 2,913,738 | 11/1959 | Wise | 5/67 |
| 3,036,723 | 5/1962 | McCormick et al. . | |
| 3,062,500 | 11/1962 | Arnes et al. | 254/7 |
| 3,223,251 | 12/1965 | Rothe et al. | 414/678 |
| 3,256,040 | 6/1966 | Mize et al. | 297/310 |
| 3,373,879 | 3/1968 | Verini . | |
| 3,451,656 | 6/1969 | Goodacre | 254/8 |
| 3,455,465 | 7/1969 | Rachman | 214/1 |
| 3,476,404 | 11/1969 | Rachman | 280/30 |
| 3,865,427 | 2/1975 | Delany | 296/68 |
| 4,013,135 | 3/1977 | Kechely | 177/144 |
| 4,016,005 | 4/1977 | DiMatteo | 297/DIG. 4 |
| 4,192,549 | 3/1980 | Petersen | 297/464 |
| 4,227,740 | 10/1980 | East | 297/310 |
| 4,389,056 | 6/1983 | Tenniswood | 280/289 WC |
| 4,527,944 | 7/1985 | Qually et al. | 414/678 |
| 4,555,121 | 11/1985 | Lockard et al. | 280/30 |
| 4,561,823 | 12/1985 | Norton | 414/678 |
| 4,592,695 | 6/1986 | McConnell | 414/678 |
| 4,725,188 | 2/1988 | Zimmermann et al. | 414/678 |

FOREIGN PATENT DOCUMENTS 2125285 3/1984 United Kingdom .

OTHER PUBLICATIONS

Wheelchair Lift Assembly illustrated in Bulletin No. 2000-75, copyright Metal Dynamics Corp., 1971.

Bulletin from Saninaw Steering Gear division, No. PPA-383.

*Primary Examiner*—Leslie J. Paperner

*Attorney, Agent, or Firm*—Seidel, Gonda, Lavorgna & Monaco

[57] ABSTRACT

A lift for tilting a wheelchair intended for use by a physician, dentist or the like in treating a wheelchair bound patient. The wheelchair lift assembly is portable, light weight and easily adapted to any wheelchair structure so as to provide proper support for the chair and occupant as well as provide the necessary angle of repose. The wheelchair lift assembly generally includes a frame, piston and lift linkage for causing rotation of the wheelchair about its rear wheels and stabilizer bars that support the wheelchair in the tilted position and prevent over rotation. Also provided is a detachable footrest support for the comfort of the wheelchair occupant when the wheelchair is lifted by the assembly.

9 Claims, 5 Drawing Sheets

FIG 4
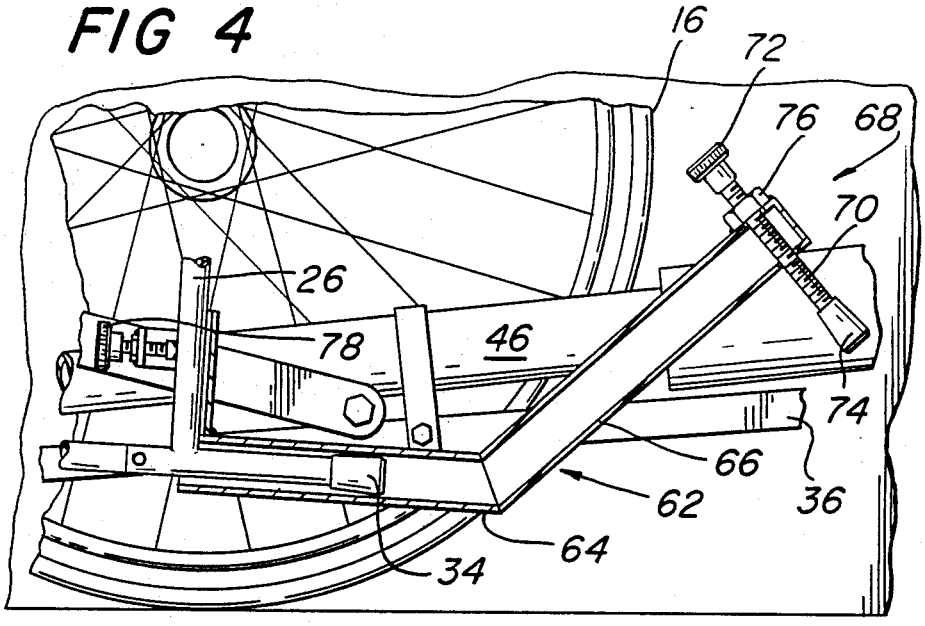
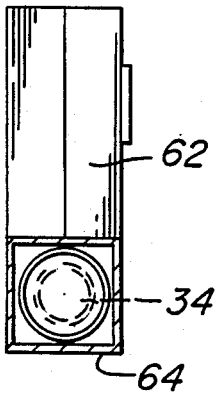
FIG. 5
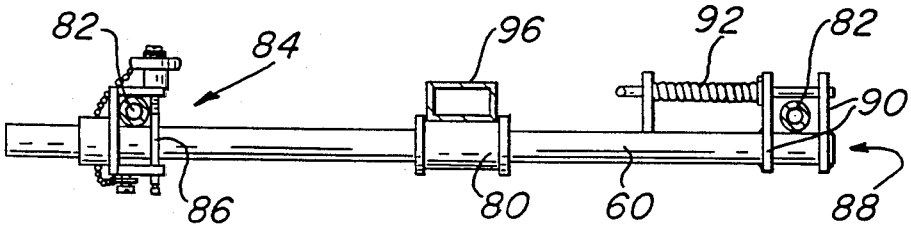
FIG 6

FIG. 7
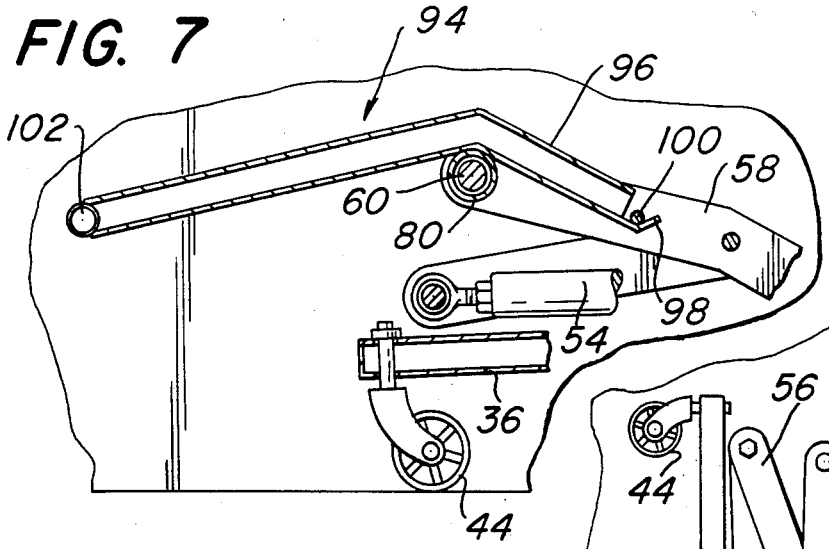
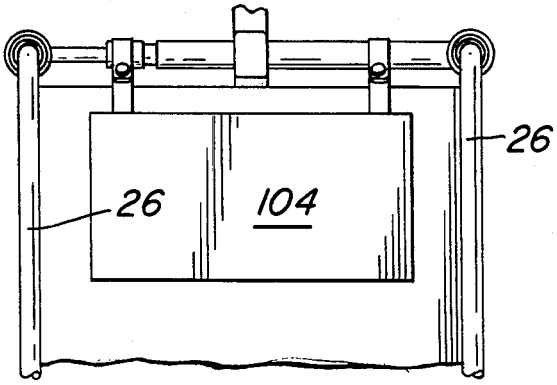
FIG. 8
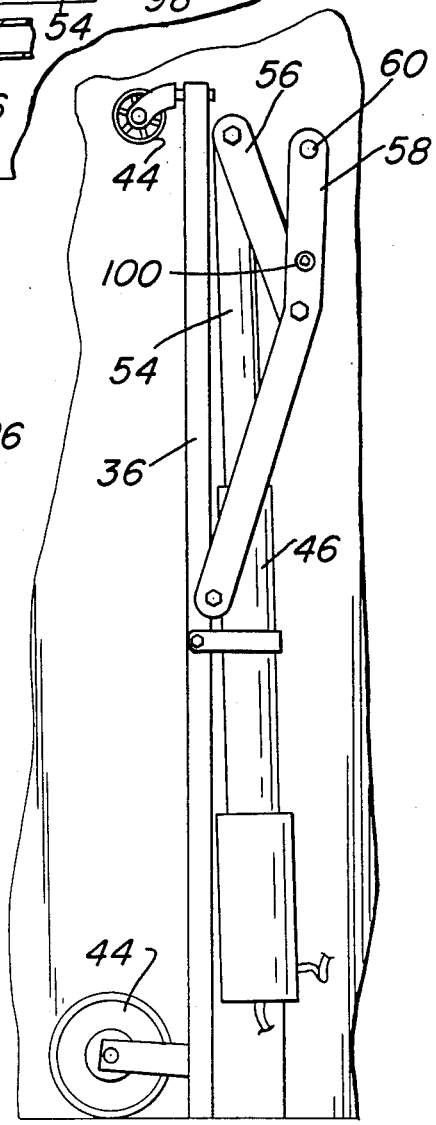
FIG. 9

PORTABLE WHEELCHAIR LIFT

BACKGROUND OF THE INVENTION

The present invention relates to a lift and tilt device for a wheelchair and more particularly a lift and tilt device which is portable, lightweight, quickly connected and disconnected to any number of wheelchair structures, and may be easily stored when not in use.

The transfer of non-ambulatory persons in wheelchairs to a dental or barber chair may sometimes be hazardous to the person's health and, at the very least, difficult and uncomfortable. Dental care presents a particularly difficult problem in that the patient is preferably placed in a prone position during examination. Patients with neurological diseases or others who may need dental care cannot always be moved easily to a conventional dental chair. These patients are typically treated in their wheelchairs, while the dentist must assume a strained or contorted position, to perform the necessary examination or therapy. This results in extreme fatigue on the dentist and a reduction of the dentists' ability to render proper care.

Wheelchair lifts that also tilt are generally known in the art. For example, see U.S. Pat. Nos. 3,476,404 and 3,455,465 which generally show a wheelchair lift and tilt device, as well as those shown in U.S. Pat Nos. 4,389,056, 4,192,549, 4,527,944 and 4,561,823, include large support platforms and/or complex support frames. However, it is desired to provide a structure that is portable, easily assembled, conveniently stored in an out of the way place and easily transferred from location to location as desired.

SUMMARY OF THE INVENTION

The present invention relates to a portable wheelchair lift and tilt assembly including a frame, piston and linkage combination for actuation of the lifting and tilting function, and a stabilizing means for maintaining the wheelchair and patient in the desired position without tipping or over rotation of the chair about its rear wheels. The overall construction of the lift assembly and stabilizing means permits the present invention to be stored easily in a closet or corner for use when required as well as is lightweight and portable from location to location without undue strain.

Further advantage of the invention will become apparent by particularly describing a preferred embodiment thereof. For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 4 shows a partial cross-sectional view of the lift assembly as taken along line 4—4 in FIG. 3.

FIG. 5 is a cross-sectional view of the lift assembly as taken along line 5—5 in FIG. 3.

FIG. 6 is a cross-sectional view of the lift assembly as taken along line 6—6 in FIG. 3.

FIG. 7 is a partial cross-sectional view of the lift assembly taken along line 7—7 in FIG. 3.

FIG. 8 is a partial front view of the lift assembly as viewed along line 8—8 in FIG. 2.

FIG. 9 is a side view of the lift assembly as self supported for storage.

DETAILED DESCRIPTION OF THE DRAWINGS

Figure 1:
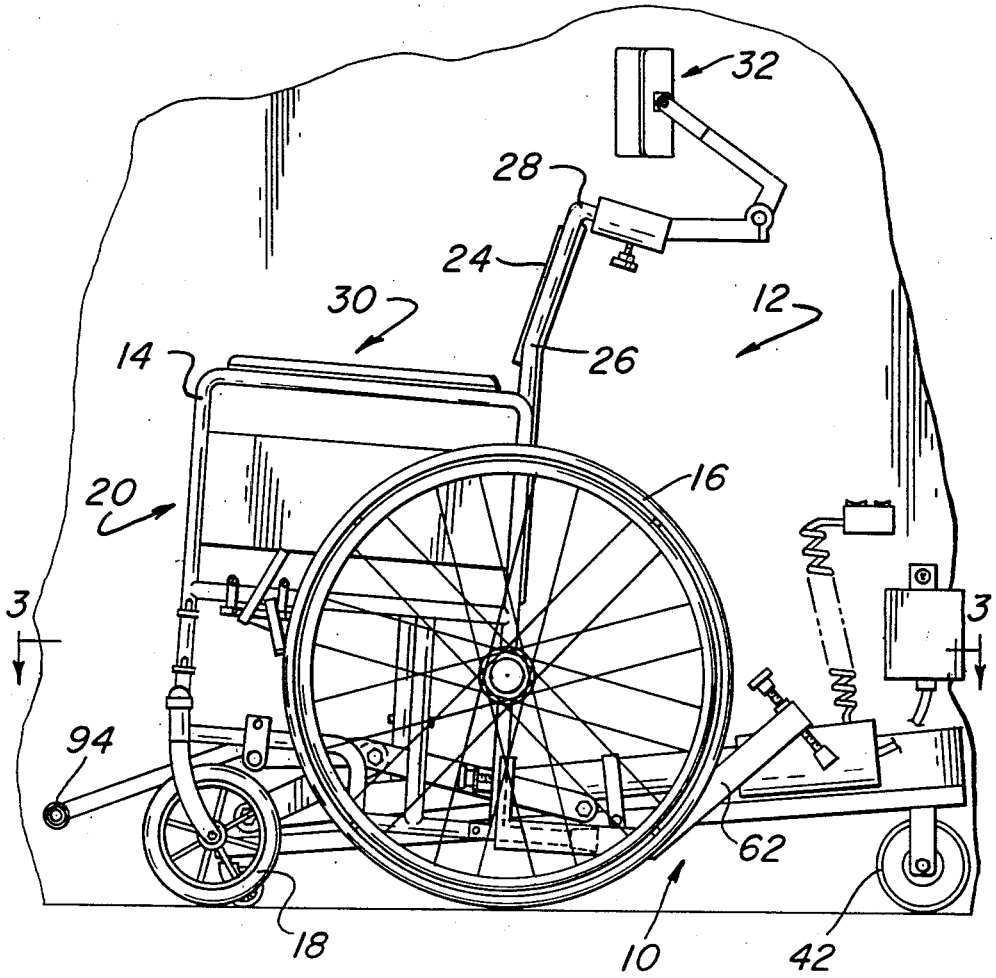
FIG. 1 shows a typical wheelchair in its normal use position with the wheelchair lift assembly of the present invention fixed to the wheelchair.
Figure 2:
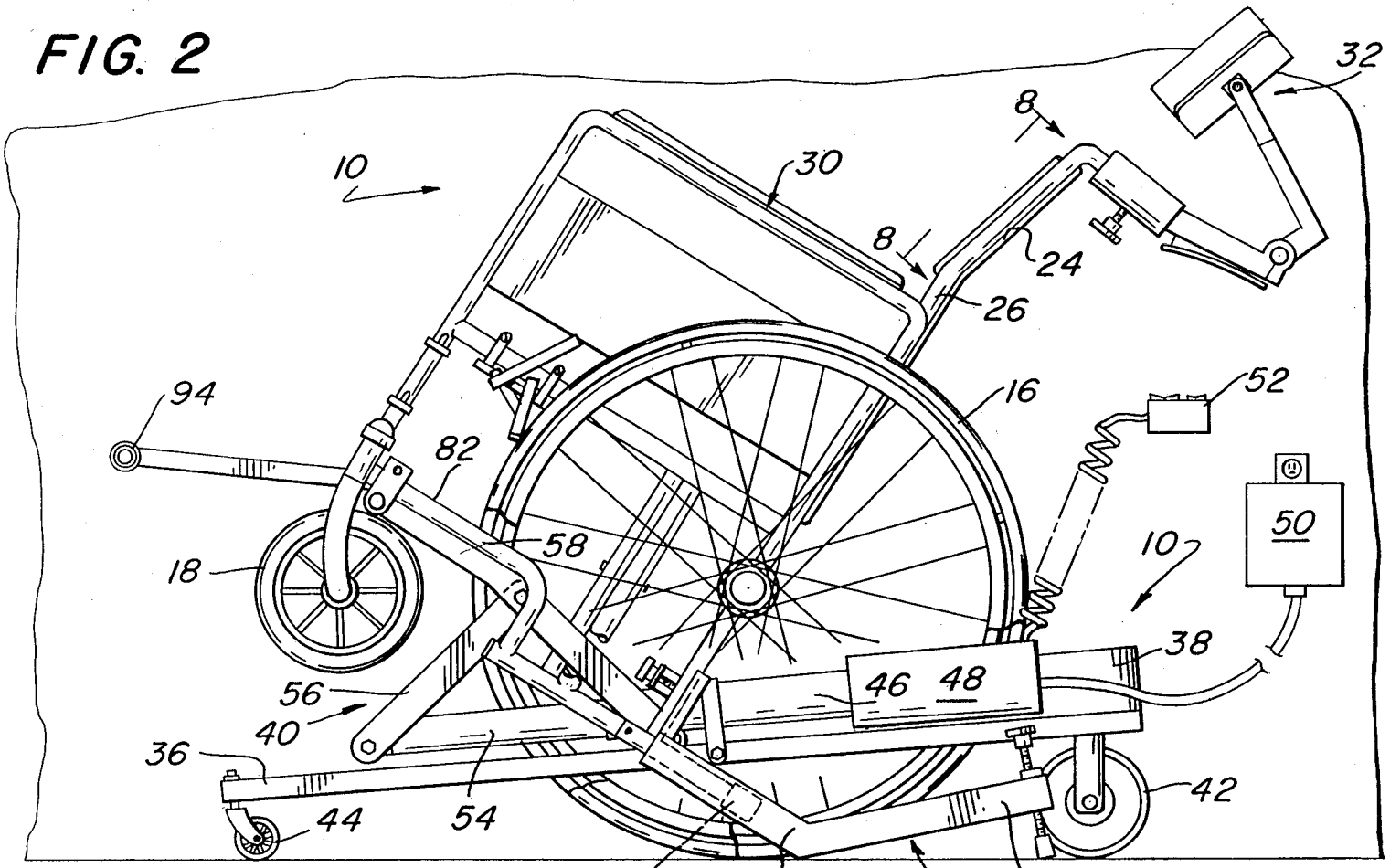
FIG. 2 shows the lift assembly of FIG. 1 with the wheelchair in the tilted position.

Referring to the drawings where like numerals indicate like elements there is shown in FIGS. 1 and 2 a wheelchair lift and tilt assembly, generally designated by the numeral 10. A wheelchair, generally designated by the numeral 12, is shown attached to the lift assembly 10 and may be regarded as representative of the any number of wheelchair construction as presently known and sold. The structure of the wheelchair does not form a part of the present invention.

The wheelchair 12, as shown, generally includes a frame 14, a pair of large rear wheels 16 rotatably fixed to the rear of frame 14, and a pair of relatively small diameter front wheels 18 preferably of the caster type. The frame 14 is typically collapsible and includes a fabric or flexible seat 20 which is suspended between opposite sides of the frame 14 and may be padded as desired. Footrests may also be supported from the frame 14 but are not shown in the present drawings. Frame 14 also includes a fabric or flexible backrest 24 which extends between uprights 26 which project upwardly as part of the rear of the frame 14. Typically, at the top of uprights 26 are two horizontal, rearwardly extending handles 28 for pushing the wheelchair 12 from behind. Adjacent each side of the seat 20 and projecting forward from the mid-section of the uprights 26 are armrests 30. In the normal use of the present invention it is typically required that a headrest 32 be utilized. The headrest 32 may take any form as desired such as that described in prior U.S. Pat. No. 3,476,404 and as shown is attached to the wheelchair at the handles 28.

In FIG. 1 the wheelchair 12 is shown attached to the assembly 10 ready for lifting and tilting so as to place the occupant in the prone position. In FIG. 2 the wheelchair 12 is shown in the lifted and tilted position with the closest rear wheel 16 of the wheelchair 12 being shown patially broken away so as to illustrate the structure of the assembly 10.

Figure 3:
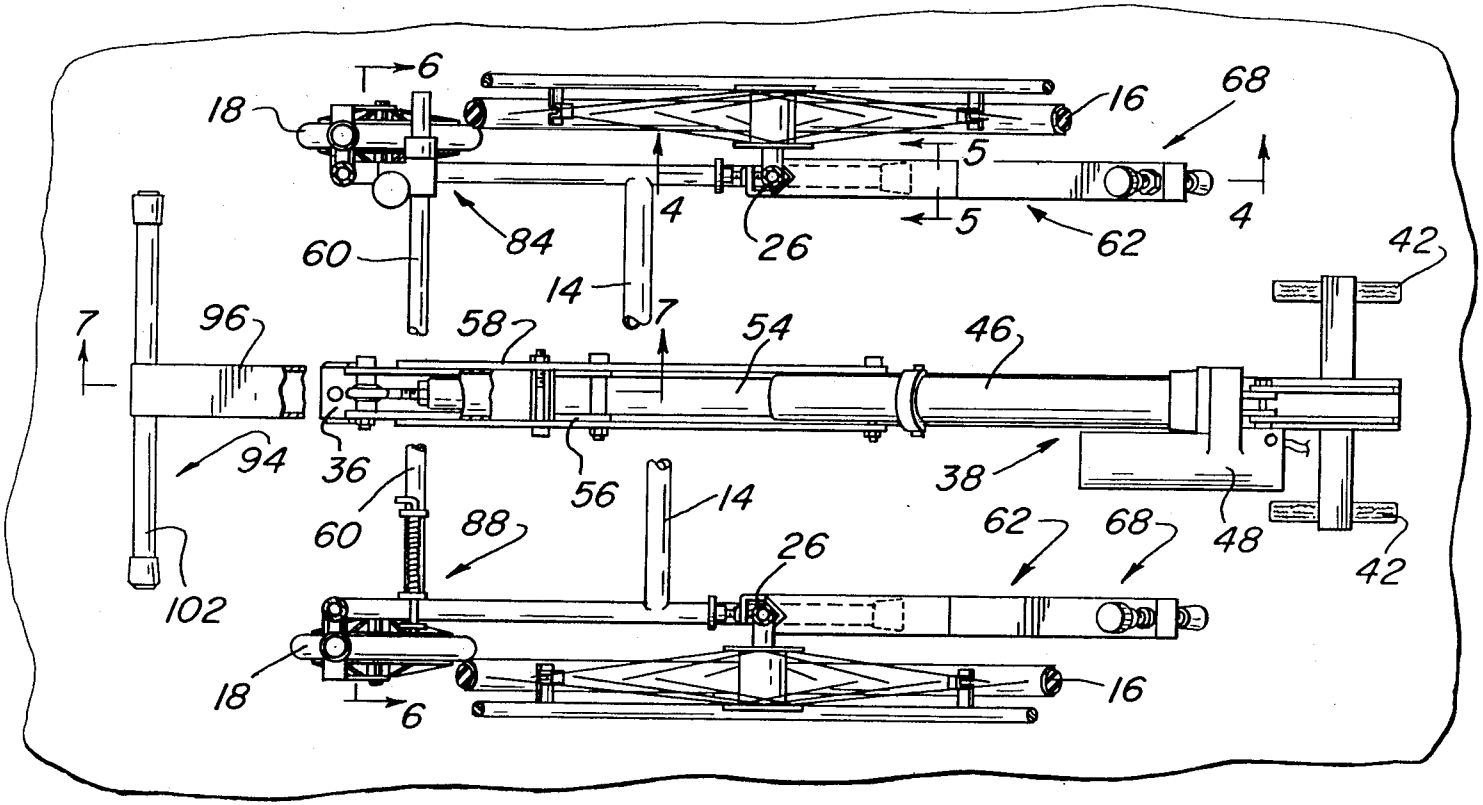
FIG. 3 shows a top cross-sectional view of the lift assembly as taken along line 3—3 of FIG. 1.

Assembly 10 of the present invention as illustrated in FIGS. 1-3 generally includes a support frame 36, a piston assembly 38 and lift linkage 40. Assembly frame 36 is supported in its operative position by rear wheels 42 which are spaced laterally with respect to the frame 36 for stabilizing the assembly 10. Frame 36 also includes a front wheel 44. Wheels 42 and 44 permit the assembly 10 to be inserted along the floor below the wheelchair 12 between its rear wheels 16 prior to lifting or may be used to roll the assembly 10 during transport or when being placed into storage. The piston assembly 38 includes a cylinder 46, an actuator 48 connected to an electrical power source at 50, and a lift control 52. The piston cylinder 46 may be hydraulic, a ratchet and screw combination or as desired and is rigidly fixed to the frame 36 with its piston rod 54 attached to lift linkage 40.

Lift linkage 40 transfers the stroke of the piston rod 54 to lift or lower the front end of the wheelchair 12.

The end of piston rod 54 is pivotably attached to a first link 56 at one end thereof. The opposite end of the first link 56 is attached to a second link 58 at approximately its mid-span. The second link 58 is pivotably attached at one end to the assembly frame 36. The opposite end of second link 58 is pivotably attached to a support bar 60, as illustrated in FIG. 3 and described below. Support bar 60 is in turn attached to the wheelchair frame 14 and is secured to the wheelchair 12 during lifting.

The wheelchair lift assembly 10 also includes tilt stabilizer bars 62. The structure of the stabilizer bars 62 is illustrated generally in FIGS. 1–3 and in cross-section in FIGS. 4 and 5. One stabilizer bar 62 is attached to each side of the wheelchair frame 14 at the rear frame extensions 34. However, it is contemplated that stabilizer structure 62 may be secured to the assembly support frame 36 or to the wheelchair 12 in any manner as desired. The stabilizer bars 62, as illustrated, generally include a first portion 64 and a second portion 66 which are rigidly attached to one another at an angle of greater than 90°. Second portion 66 includes an adjustable support 68 at its end opposite the attachment to first portion 64. Adjustable support 68 includes a threaded shaft or bolt 70 having an actuation handle 72 at one end and a bumper 74 at the opposite end. Shaft 70 is secured to the second portion 66 by means of a threaded engagement with nut 76 which is attached to the second portion by welding or the like. Handle 72 rotates shaft 70 within nut 76 to adjust the extension of bumper 78 from portion 68 and, therefore, the maximum angle of tilt of the wheelchair 12 upon lifting. The first portion 64 is attached to the wheelchair frame 14 by sliding engagement with the frame extension 34. As illustrated particularly in FIGS. 4 and 5 the extension 34 is inserted into the hollow of first portion 64 with the stabilizer bar 62 clamped onto the frame upright 26 by means of a thumb screw 78.

The structure of the stabilizer bar 62 permits the wheelchair to be tilted on its rear wheels upon the lifting action created by piston 46 and lift linkage 40 and sets the maximum rotation of the wheelchair about its rear wheel 16 to prevent the wheelchair 12 from over rotating or tipping backwards. The angled relationship of the first portion 64 with second portion 66 permits the adjustment of the wheelchair to the tilted position with support 68 fixing the desired angle for the comfort of the patient and dentist or the like. Upon lowering of the wheelchair 12 to its normal, untilted position, thumb screws 78 are released from their grip on the frame 14 and the stabilizer bars 62 easily removed for storage.

As particularly illustrated in FIGS. 3 and 6, lift linkage 40 and support bar 60 engage the wheelchair frame 14 to translate the retraction of piston rod 54 into cylinder 46 to lift and tilt the wheelchair 12 about its rear wheels 16. Support bar 60 is generally in the form of a transversely positioned rod which extends between the opposite sides of frame 14 and which is supported at pivot 80 by second link 58 of the linkage 40. The pivot 80, as illustrated, is in the form of a sleeve to allow support bar 60 to rotate during the change in angle of the linkage 40 when lifting. Support bar 60 is attached to front 82 of the frame 14.

Supporting bar 60 generally includes a clamping mechanism at each end to engage both sides of the frame front 82. As illustrated particularly in FIG. 6, the first clamp 84 generally includes a projecting C-shaped frame which is secured around the wheelchair frame front 82 and retained by pin 86. Clamp 84 may be of the type which is slidingly positioned along the length of the support bar to adapt to various size and structures of wheelchair frames 14. The second clamp 88 on the opposite end of support bar 60 includes two projections 90 which are locked around frame front 82 by means of a spring actuated pin 92. However, both first clamp 84 and second clamp 88 may take any form as desired so as to detachably secure the support bar 60 and lift linkage 40 to the wheel chair frame 14.

As particularly in FIGS. 6 and 7, the wheelchair lift assembly 10 may also include a detachable footrest 94. Footrest 94 includes an angled bar 96 having a hook 98 projecting from one end. Hook 98 engages a pin 100 extending transversely through second link 58 of lift linkage 40. Bar 96 is supported at its angle on sleeve 80 which pivotably engages the support bar 60. Angled bar 96 projects forward of the lift linkage 40 and terminates in a T-bar 102 or similar structure on which the feet of the wheelchair occupant is supported in a comfortable position so as not to dangle from the wheelchair 12 when lifted. Footrest 94 may be utilized as a replacement for the footrests on a wheelchair (not shown) or if such footrests are not provided.

FIG. 8 illustrates an optional pad 104 that may be desired for the comfort of the wheelchair occupant when placed in the lifted position. The pad 104 is attached to the headrest structure 32 and hangs loosely over the backrest 24 of the wheelchair 12.

FIG. 9 illustrates the wheelchair lift assembly 10 standing in an upright position with the rear wheels 42, butt end of the piston assembly 38 and frame 36 providing support for maintaining the assembly vertical. This arrangement permits storage of assembly 10 within a closet, corner or other out of the way place.

It is the purpose of the present invention to provide a portable, light weight and simple wheelchair lift assembly for tilting the wheelchair and maintaining the chair and occupant in an angled or prone position for examination during dental or similar type procedures. It is contemplated that lift control 52 raises and lowers the angle of the wheelchair through adjustment of piston 46 as desired with the stabilizer bars 62 setting the maximum angle and preventing over rotation of the chair.

The present invention may be embodied in other specific forms without departing from the spirit or essential attributes thereof and, accordingly, reference should be made to the appended claims, rather than to the foregoing specification, as indicating the scope of the invention.

I claim:

1. A portable lift assembly for a wheelchair of the type generally including a frame, a pair of large rear wheels and small caster-type front wheels, one of each pair being attached to and outward of opposite sides of the frame, and a seat and seat back extending between opposite sides of the frame to support a person therein, the lift assembly comprising: a support frame adapted for insertion below the frame of the wheelchair between the opposite wheels; piston means attached to the support frame; linkage pivotably attached to the support frame and the piston means; a support bar pivotably attached to said linkage and adapted for releasable engagement with opposite sides of the wheelchair frame forward of the axis of the rear wheels of the wheelchair, said support bar including at least one clamp means adapted for slidable engagement of the wheelchair frame and for adjustment to accommodate attachment to various size wheelchair frames; said linkage and support bar adapted to translate a linear stroke of the piston means to a vertical movement of the wheelchair at its engagement with the support bar, whereby upon activation of the piston means causes lifting of the front of the wheelchair frame and tilting of the wheelchair about the rear wheel axes and stabilizer means adapted for detachable engagement with the rear of the wheelchair frame to limit the rotation of the wheelchair about the rear wheel axis upon lifting.

2. A portable lift assembly as claimed in claim 1 further comprsing: headrest means detachably secured to the rear of the wheelchair frame and adapted for adjustable support of the person's head when the wheelchair is in the titled position.

3. A portable lift assembly as claimed in claim 1 wherein the stabilizer means further comprises adjustable support means for varying the maximum angle of tilt of the wheelchair in the lifted position.

4. A portable lift assembly for a standard wheelchair of the type generally including a frame, a pair of large rear wheels and small caster-type front wheels, one of each pair being attached to opposite sides of the frame, and a seat and seat back extending between the opposite sides of the frame to support a person therein, the lifted assembly comprising: a support frame adapted for movable insertion below the frame of the wheelchair between opposite wheels thereof and transverse to the axis of the wheels, the support frame riding on at least one pair of stabilizing wheels; piston means attached to the support frame on one end thereof and adapted to direct its piston stroke longitudinally along the support frame between the wheels of the wheelchair when said support frame is inserted below the wheelchair frame; linkage pivotably attached to the support frame at the opposite end of the support frame from the piston means attachment, said linkage including a first link pivotably attached to the movable end of the piston means and a second link forming at one end the pivotable attachment of the linkage with the support frame, the first link pivotably attached to the second link about the midspan thereof; a transversely mounted support bar pivotably supported at the end of the second link opposite its attachment to the support frame, the support bar adapted for a releasable engagement at opposite ends with the opposite sides of the wheelchair frame adjacent the front wheels thereof; and stabilizer means for detachable engagement with the rear of the wheelchair frame adjacent the rear wheels thereof, the stabilizer means adapted to limit the rotation of the wheelchair about its rear wheels upon lifting, whereby the support bar attached to the front of the wheelchair frame translates the linear movement of the piston means, acting through the linkage, to a vertical movement of the front of the wheelchair frame and a resultant rotation and tilting of the wheelchair about the axis of the rear wheels.

5. A portable lift assembly for releasable attachment to the frame of a typical wheelchair and for tilting the wheelchair about its rear wheels, the portable lift assembly comprising: a support frame adapted for movable insertion below the frame of the wheelchair between opposite wheels and transverse to the axes thereof; a transversely-positioned support bar adapted for releasable engagement at opposite ends with opposite sides of the wheelchair frame forward of the axes of the rear wheels; lift means attached to said movable support frame and pivotably supporting the support bar, the lift means adapted to cause a vertical lift of the support bar thereby causing a vertical movement of the front of the wheelchair frame at the support bar engagement with the wheelchair frame and to tilt the wheelchair about its rear wheel axis, whereby the lift assembly may be inserted between the wheels of the wheelchair, releasably engage the opposite sides of the support frame and actuated to cause the front portion of the wheelchair frame to move vertically and tilt the wheelchair about its rear wheels and maintain the wheelchair and the person therein in a tilted position.

6. A portable lift assembly as claimed in claim 5 further comprising: support wheels attached to the support frame at opposite ends thereof, the support wheels on at least one end being spaced laterally with respect to the frame to stabilize the support frame.

7. A portable lift assembly as claimed in claim 5 further comprsing: a detachable footrest supported on the lift linkage and adapted to extend forward of the wheelchair.

8. A portable lift assembly as claimed in claim 5 further comprising stabilizer means for detachable engagement with the wheelchair frame and adapted to limt the rotation of the frame about the rear wheels upon tilting.

9. A portable lift assembly as claimed in claim 5 further comprising means on said stabilizer means for adjusting the rotational limit of the wheelchair.

* * * * *